US006595837B2

(12) United States Patent
Raklovits et al.

(10) Patent No.: US 6,595,837 B2
(45) Date of Patent: Jul. 22, 2003

(54) SHARPENING STAND FOR A CUTLERY DEVICE

(75) Inventors: Gregory O. Raklovits, St. Joseph, MI (US); Lawrence A. Doggett, Stevensville, MI (US); David A. Swinden, Ellenville, NY (US)

(73) Assignee: Whirlpool Corporation, Benton Harbor, MI (US)

( * ) Notice: Subject to any disclaimer, the term of this patent is extended or adjusted under 35 U.S.C. 154(b) by 94 days.

(21) Appl. No.: 09/829,088

(22) Filed: Apr. 9, 2001

(65) Prior Publication Data

US 2001/0029670 A1 Oct. 18, 2001

Related U.S. Application Data

(60) Provisional application No. 60/961,228, filed on Apr. 10, 2000.

(51) Int. Cl.[7] ..... B24B 3/54
(52) U.S. Cl. ..... 451/321
(58) Field of Search ..... 451/312, 319, 451/321; 30/123

(56) References Cited

U.S. PATENT DOCUMENTS

| | | | | |
|---|---|---|---|---|
| 137,648 A | | 4/1873 | Ayers | |
| 343,665 A | | 6/1886 | Leiter | |
| 656,457 A | | 8/1900 | Hirsch | |
| 646,175 A | | 12/1900 | Polchow | |
| 1,167,387 A | | 1/1916 | Daniel | |
| 1,457,606 A | | 6/1923 | Schlehr | |
| 1,997,131 A | | 4/1935 | Champlin | 30/9 |
| 2,142,137 A | | 1/1939 | Leary | 30/340 |
| 2,410,572 A | | 11/1946 | Echikson | 30/344 |
| 3,894,362 A | * | 7/1975 | Graves | 451/552 |
| 4,011,657 A | | 3/1977 | Vance | 30/329 |
| 4,231,194 A | * | 11/1980 | Glesser | 451/552 |

(List continued on next page.)

FOREIGN PATENT DOCUMENTS

| | | | | |
|---|---|---|---|---|
| EP | 1223006 A2 | * | 7/2002 | B24D/15/08 |
| GB | 2134020 A | * | 8/1984 | B24B/03/52 |

*Primary Examiner*—Joseph J. Hail, III
*Assistant Examiner*—David B. Thomas
(74) *Attorney, Agent, or Firm*—Robert O. Rice; John F. Colligan; Stephen Krefman

(57) ABSTRACT

A cutlery device is provided having a blade with a sharpened edge and an opposite, unsharpened back. The cutlery device also includes a tang extending from the blade which is at least partially enclosed in a handle. The tang has a tapered thickness to produce a cutlery device that is balanced when grasped with some fingers on the handle and some fingers on the blade. The back of the blade is curved so that a finger may be comfortably pressed against the back. The handle is curved for comfort and pieces of the handle are secured on the tang with rivets of varying length to accommodate the shape of the handle. A sharpening aid is also provided for the cutlery device which has at least one angled wall for positioning a sharpening surface at a sharpening angle, permitting the cutlery device to be held with the blade positioned vertically during a sharpening operation.

17 Claims, 2 Drawing Sheets

U.S. PATENT DOCUMENTS 4,259,815 A * 4/1981 Kuban ..... 451/552
4,450,653 A * 5/1984 Fletcher ..... 248/171
4,470,327 A 9/1984 Gerber, Jr. et al. ..... 76/104 R
4,512,112 A 4/1985 LeVine ..... 51/221
4,624,079 A * 11/1986 Bonapace ..... 451/555
4,640,058 A * 2/1987 Glesser ..... 451/540
4,646,477 A * 3/1987 Robertson ..... 451/540
4,719,722 A * 1/1988 Washburn ..... 451/557
4,731,953 A * 3/1988 Owen ..... 269/3
4,751,795 A * 6/1988 Jenne ..... 451/461
4,799,335 A * 1/1989 Battocchi ..... 451/241
4,912,885 A * 4/1990 Bonapace ..... 451/45
4,974,322 A 12/1990 Butka ..... 30/138
4,991,357 A 2/1991 Stickles, Sr. ..... 51/214
D316,015 S 4/1991 DiGangi ..... D7/137
D318,782 S * 8/1991 LeBeau ..... D8/91
5,050,749 A 9/1991 Scaglione ..... 211/70.7
5,113,587 A 5/1992 Loomis ..... 30/340
D327,402 S * 6/1992 Button et al. ..... D8/93
D328,847 S * 8/1992 Button et al. ..... D8/93
5,185,958 A 2/1993 Dale ..... 51/68
5,199,225 A 4/1993 Esposito ..... 51/214
5,210,925 A 5/1993 Morgulis ..... 29/527.4
5,390,431 A 2/1995 Friel ..... 451/45
5,458,534 A * 10/1995 Campione et al. ..... 451/541
5,461,785 A 10/1995 Sol Na ..... 30/128
5,528,834 A 6/1996 Seber et al. ..... 30/340
5,655,959 A * 8/1997 Juranitch ..... 451/486
5,692,308 A 12/1997 Di Libero ..... 30/353
5,724,739 A 3/1998 Hutton ..... 30/356
5,749,153 A * 5/1998 Viens ..... 33/42
5,791,055 A 8/1998 Mangol ..... 30/340
D404,633 S 1/1999 Rivera ..... D8/99
D409,070 S 5/1999 Elishewitz ..... D8/98
6,048,262 A * 4/2000 Ray ..... 451/524
6,168,509 B1 * 1/2001 Presgrove ..... 451/371
6,371,841 B1 * 4/2002 Ray ..... 451/523

* cited by examiner

FIG 7
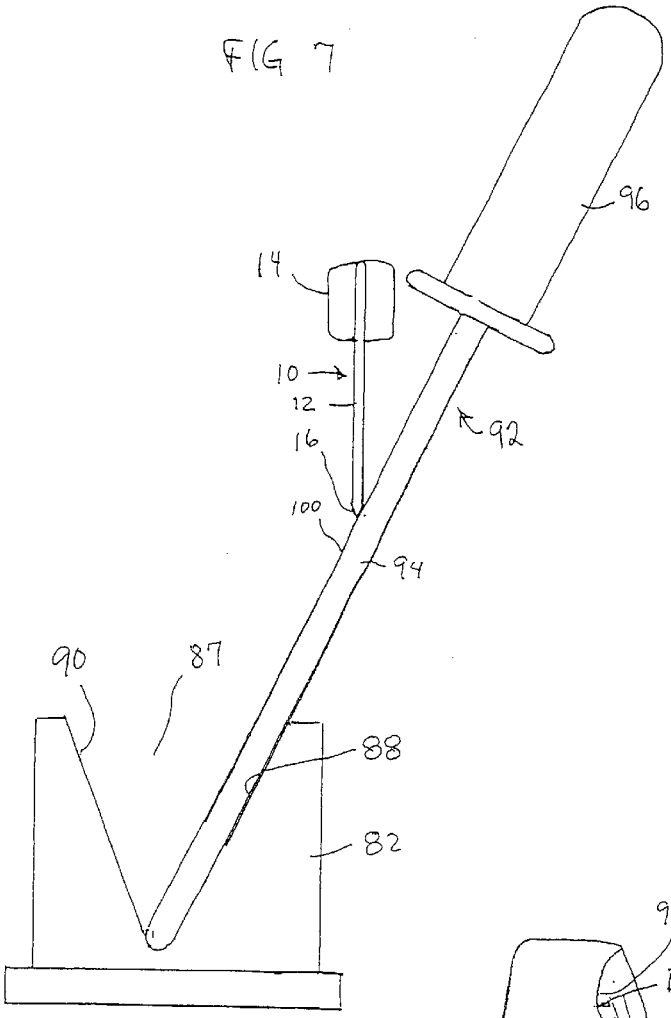
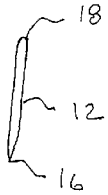
FIG. 5
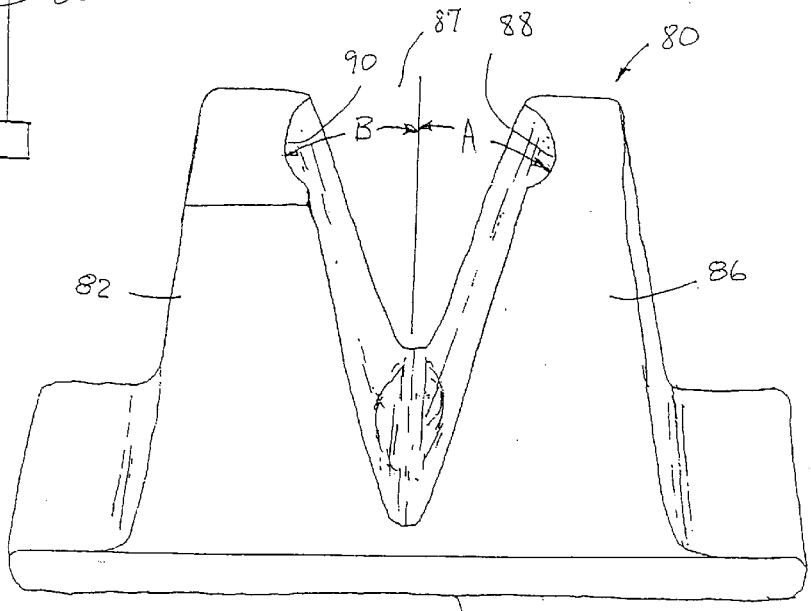
FIG 6

SHARPENING STAND FOR A CUTLERY DEVICE

BACKGROUND OF THE INVENTION

The present invention relates to cutlery devices, such as knives, and in particular to a cutlery device which is balanced for use by a chef or other user, as well as a sharpening aid for a cutlery device.

Cutlery devices such as knives are well known and are provided in many different sizes and shapes for particular uses. A typical fixed blade knife has a blade portion at one end, generally with a point at a distal end, and a handle at an opposite end. The blade usually has one sharpened edge along its length and an opposite unsharpened edge referred to as a back of the blade. An extension of the blade, called the tang, extends into the handle portion and is usually surrounded by or encased in an additional handle piece or pieces forming a shape to be grasped by a user. An area between the blade and the handle is often provided in an enlarged form as a hilt which, among other things, helps to prevent slippage of the user's fingers onto the sharpened portion of the blade.

Many users of knives grasp the knife solely in the handle area, keeping all of the fingers and thumb behind the hilt during use. In order to make the knife useful over a long period of time with such an arrangement, it is important to have the center of gravity of the knife located nearly centrally within the handle portion in order to provide a balance to the overall knife which is located in the area being gripped by the user. Typically the tang extends rearwardly from the blade at a constant thickness such as shown in U.S. Pat. Nos. D316,015 and 4,470,327.

Oftentimes the handle is formed of two separate pieces which are attached to opposite sides of the tang and are secured on to the tang by rivets which may be of equal sizes as shown in U.S. Pat. Nos. 2,142,137 and 4,470,327.

Chefs and other food service professionals grasp knives and similar cutlery devices in a somewhat different manner than domestic users, that is, they position their hand more towards the tip of the cutlery device, oftentimes placing the index finger and thumb forward of the hilt. In order for the cutlery device to be used over a long period of time without a build up of fatigue, it would be an improvement to provide such a device with a balance more forward, toward the tip, than is present in many available cutlery devices.

The sharpening devices for cutlery, such as knives, are known and typically include a complex arrangement to hold the cutlery device at a particular angle for sharpening, such as disclosed in U.S. Pat. No. 5,185,958, or provide some other arrangement for engaging and holding the knife blade at a particular orientation relative to the sharpening surface, such as disclosed in U.S. Pat. Nos. 4,799,335; 4,991,357; 5,199,225 or 5,390,431. In many instances the user is required to hold the knife at an angle other than vertical for sharpening which is an unnatural and somewhat cumbersome. Further, the apparatus for holding the sharpening surfaces in some of these prior constructions is complex and thus costly.

SUMMARY OF THE INVENTION

The present invention provides a balanced cutlery device for use by chefs and other professional food service personnel wherein the cutlery device is normally grasped at the forward part of the handle, with a portion of the hand extending over the hilt. In order to provide a comfortable balance for the cutlery device, the tang is tapered toward the rear of the handle in order to diminish the weight of the tang in a rearward direction of the cutlery device. In a preferred embodiment, the back of the blade is generally rounded to allow the user to place an index finger on the back of the blade to comfortably apply pressure on the back during slicing.

In an embodiment, the handle portion of the cutlery device is curved on its side faces to provide additional comfort to the user. However, this requires different sized rivets to be used to secure the handle pieces together.

Finally, a sharpening aid is provided for the cutlery device comprising a stand for a sharpener that allows the user to maintain the knife in a vertical orientation while sharpening, rather than requiring the user to hold the knife at a sharpening angle.

BRIEF DESCRIPTION OF THE DRAWINGS

FIG. 5 is a section view taken generally along the line V—V of FIG. 1.

FIG. 6 is a perspective view of a sharpening aid for use with a cutlery device.

FIG. 7 is a side elevational view of the sharpening aid of FIG. 6 in use.

DETAILED DESCRIPTION OF THE PREFERRED EMBODIMENTS

Figures 1, 2, 3, 4:
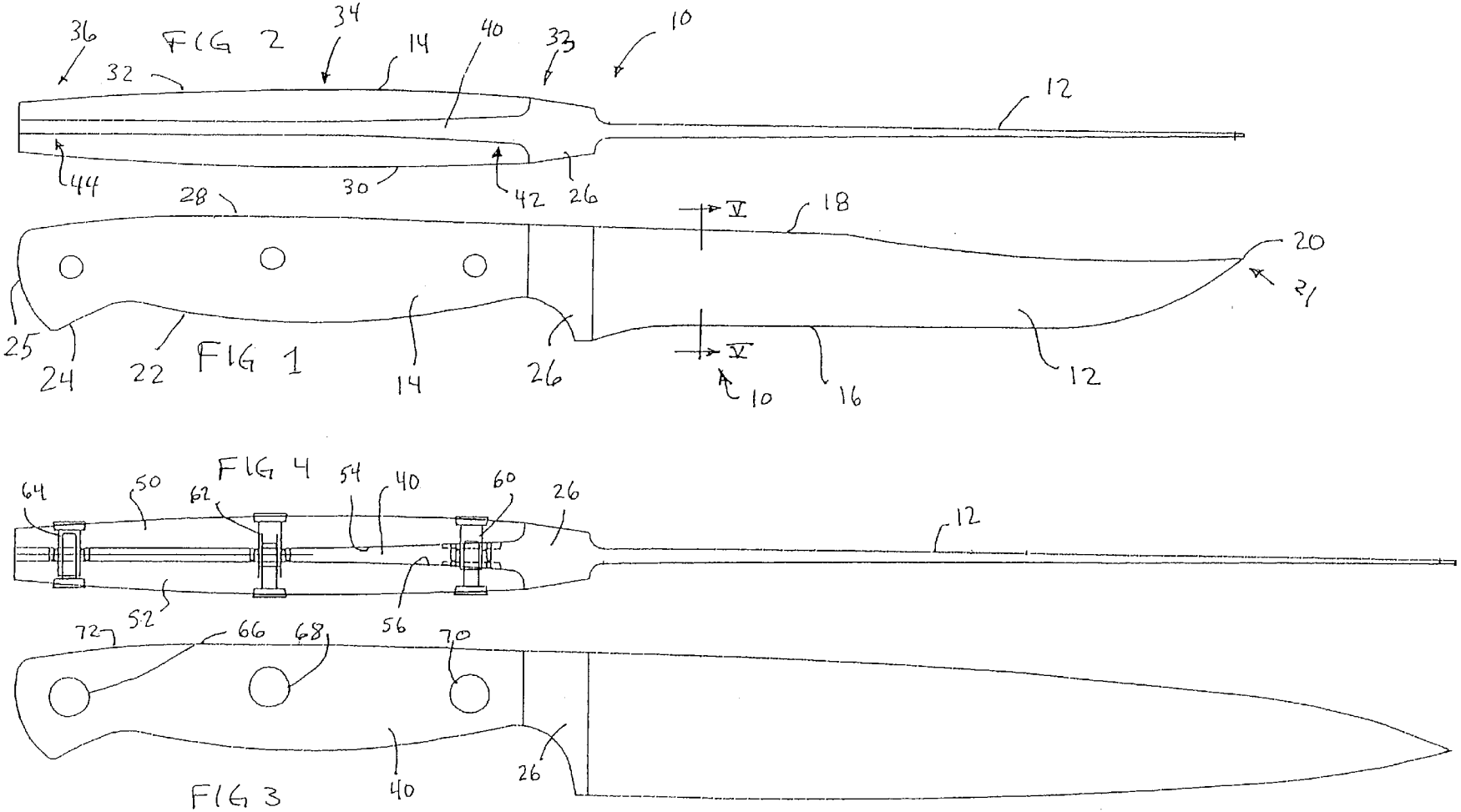
FIG. 1 is a side elevational view of a knife embodying the principles of the present invention.
FIG. 2 is a top elevational view of the knife of FIG. 1.
FIG. 3 is a side elevational view of a knife embodying the principles of the present invention with the handle portions removed.
FIG. 4 is a top sectional view of the knife of FIG. 3 with the handle portions attached.

In FIG. 1 there is illustrated a cutlery device generally at 10 which comprises a blade portion 12 at a first end and a handle portion 14 at a second end. The blade portion 12 has one edge 16 which is sharpened and an opposite edge 18, referred to as the back, which is not sharpened. A pointed tip 20 is provided at a distal end 21.

The handle portion 14 has a lower edge 22 which is contoured to receive the fingers of a user and may include an enlarged area 24 at a rearward end 25 or butt of the cutlery device and an enlarged forward end 26 referred to as a hilt. Both of these enlarged portions prevent the cutlery device 10 from slipping forward or backward within the user's hands during use, in that during use sometimes the user's hands become wet or greasy and the cutlery device is subject to slippage.

An opposite, upper edge 28 of the handle may be slightly curved, again for comfort purposes.

As seen in FIG. 2, in a preferred embodiment, side faces 30, 32 may be curved along their length for comfort purposes with a forward end 32 of the handle being thinner than a middle portion 34 of the handle and a rearward end 36 of the handle also being thinner than the middle portion.

The blade portion 12 is formed of a strong metal material, such as stainless steel, which, in a preferred embodiment, may continue in one piece rearward to the butt end 25 of the knife. A portion of the blade which extends within the handle, as at 40, is referred to as the tang. As best seen in FIG. 3, the tang 40 has generally the same contoured shape as the handle portion 14 when viewed from the side, and when viewed from the top, the tang is tapered from a forward end 42 near the hilt 26 (adjacent the blade portion 12) to a rearward end 44 near the butt 25 of the cutlery device. The hilt 26 may also be formed of the same material in one piece as the blade 12 and tang 40. The blade, tang and hilt portions are shaped and configured so as to maintain the entire knife in balance when a user grasps the knife with an index finger and a thumb engaging the blade and all remaining fingers engaging the handle. Typically, for a given type of knife, the blade has a certain size and shape for performing a selected cutting function, such as paring or slicing, etc., and the hilt has a certain size and configuration to prevent slippage, as described above, so it is the tang that is shaped and tapered to provide the desired balance.

The handle portion 14 includes two side pieces 50, 52 which have the same side contour as the tang, as seen in FIGS. 1 and 3, and which have complementary shaped inside faces 54, 56 as seen in FIGS. 2 and 4 so as to mate closely with the tapered contour of the tang 40. In this preferred arrangement, the tang is visible from above (as in FIG. 2, from below (not shown) and from a butt end view (not shown). In other embodiments, the tang could be covered by the handle pieces, so as to not be visible in one or more of these views.

The handle pieces 50, 52 are secured onto the tang by a plurality of rivets 60, 62 and 64 extending through holes 66, 68, 70 in the tang 40 in a manner that is generally known in the art. In an embodiment, such as the illustrated preferred embodiment, the handle portion 14 has side faces 30,32 which are curved, which results in the center rivet 62 being longer than either the front rivet 60 or rear rivet 64. In most embodiments the front rivet 60 is longer than the rear rivet 64.

As seen in FIG. 5, the back 18 of the blade portion 12 is rounded, that is, it has a convex curve along at least a portion of its length from the tip 20 to the tang 40, which allows the finger, generally the index finger, of the user to comfortably apply pressure on the back of the blade during slicing. This also accommodates a more forward gripping of the knife with the index finger and thumb forward of the hilt 26. Preferably the blade back 18 and an upper surface 72 of the tang 40 join in an uninterrupted, smooth manner as best seen in FIGS. 1 and 3.

FIG. 6 illustrates a sharpening aid generally at 80 in the form of a stand 82 having a large flat base 84 for resting on a counter top, table top or similar surface. An upstanding wall structure 86 is formed on the base 84 which includes a shaped recess 87 with a wall 88 arranged at an angle A from vertical, such as approximately 20°, which angle is an appropriate angle for sharpening a cutlery devices, such as a knife blade. The shaped recess 88 may include a second wall 90 formed at the same, or different angle B for use in either 20 applying a sharpened edge to an opposite side of a cutlery device at the same angle, or for providing a different angle for sharpening a different cutting edge of a different cutlery device.

As seen in FIG. 7, a sharpening tool 92, such as a rod shaped sharpening stone 94 with an attached handle 96 may be provided and which is arranged in the stand 82 and positioned in the recess 87 such that it assumes the angle A of the wall 88 and presents a sharpening surface 100 against which the sharpened edge 16 of the cutlery device 10 is to be rubbed. The cutlery device 14 is to be held with the blade portion 12 vertical, a most comfortable position for a user, and the sharpening device 92 will be held at the appropriate sharpening angle by the angle of the wall 88 in the stand 82.

For the user to sharpen an opposite lateral side of the sharpened edge 16, the sharpening device 92 can be pivoted in the base 82 to the opposite wall 90, when the wall 90 and wall 88 are formed at the same angle, with the knife then being held against an opposite surface 0*o*.1*f* the sharpening tool 92. When the angles of the walls 88 and 90 are different, the base 82 can be rotated 180°, thus presenting the sharpening tool 92 in walls 88 at the opposite angle for sharpening the second lateral side of the sharpened edge 16.

Although the sharpening aid 80 is illustrated as having two walls 88, 90, it will be appreciated that a single angled walls may be provided, with appropriate rotation of the sharpening aid for sharpening opposite sides of the cutlery device as described above, or more than two walls may be provided, at varying angles, to accommodate one or both sides of different edges to be sharpened of different tools which require sharpening at different 20 angles.

Also, although the sharpening device 92 is illustrated as a rod type of sharpening stone, other shapes of sharpening surfaces 100 may be provided as are commonly known, with appropriately shaped recesses and walls formed in the sharpening aid 80.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. A sharpening aid for a cutlery device comprising:

a stand having a base and two symetrically opposing wall structures protruding from the base; each wall structure having a wall fixed at a predetermined angle from vertical such that the wall structures form a substantially V-shaped recess;

an elongated sharpening device selectively engageable along a portion of its length against either wall of the wall structure, the sharpening device being adapted to present a sharpening surface at the angle for sharpening a blade of the cutlery device; whereby, the blade is held substantially vertical against the sharpening device for sharpening the blade at the angle.

2. The sharpening aid according to claim 1, wherein the walls are arranged at equal, but opposite angles from vertical.

3. The sharpening aid according to claim 1, wherein the angled portion of one or more of the walls comprises a shaped recess.

4. The sharpening aid according to claim 1, wherein the sharpening device comprises a rod shaped sharpening stone.

5. The sharpening aid according to claim 3, wherein the sharpening device comprises a rod shaped sharpening stone, said rod shaped stone being adapted to be arranged along its length against said recess such that the rod shaped sharpening stone assumes the predetermined angle of the wall.

6. The sharpening aid according to claim 1, wherein the angle from vertical is about 20 degrees.

7. A sharpening aid for a cutlery device comprising:

a stand having two opposing walls fixed at a predetermined angle from vertical; the walls being positioned to intersect at their base forming a vertex;

an elongated sharpening device having a tip portion and a length; the tip portion being selectively engageble in the vertex and the length being selectively engageable against either wall, the sharpening device being configured to present a sharpening surface at the predetermined angle of either one of the walls for sharpening a blade of the cutlery device; whereby, the blade is held substantially vertical against the sharpening device for sharpening the blade at the predetermined angle.

8. The sharpening aid of claim 7, wherein the recessed portion extends the length of the at least one wall.

9. The sharpening aid of claim 7, wherein the sharpening stone comprises a rod shape and is adapted to be arranged along a portion of the length of the recessed portion such that the rod shaped sharpening stone assumes the predetermined angle of the wall.

10. The sharpening claim 7, wherein the angle from vertical for that at least one wall is about 20 degrees from vertical.

11. A method for sharpening a blade of a cutlery device, comprising the steps of:

providing a stand having a base and two symetrically opposing wall structures protruding from the base; each wall structure having a wall fixed at a predetermined angle from vertical such that the wall structures form a substantially V-shaped recess;

providing a sharpening device having a tip portion and a sharpening surface along its length;

selectively engaging the tip of the sharpening device in the vertex of the V-shaped recess and selectively engaging a portion of the length of the sharpening device against either wall such that said device assumes the predetermined angle of the wall; and holding said blade substantially vertical against said sharpening device for sharpening said blade at said angle.

12. The method for sharpening a blade of a cutlery device according to claim 11, wherein the angled portion of the wall comprises a shaped recess.

13. The method for sharpening a blade of a cutlery device according to claim 11, wherein the sharpening device comprises a rod shaped sharpening stone.

14. The method for sharpening a blade of a cutlery device according to claim 11, further comprising the step of:

vertically sliding the blade against the sharpening device such that the blade traverses a portion of the sharpening device.

15. The sharpening aid for a cutlery device of claim 1, wherein the elongated sharpening device comprises a tip portion configured to selectively engage the vertex of the V-shaped recess.

16. The sharpening aid for a cutlery device of claim 15, wherein a portion of the length of the elongated sharpening device is selectively engageable with either of the walls fixed at a predetermined angle while the tip portion is engaged with the vertex of the V-shaped recess.

17. The sharpening aid for a cutlery device of claim 15, wherein the elongated sharpening device is freely moveable between the walls fixed at a predetermined angle while the tip portion is engaged with the vertex of the V-shaped recess.

* * * * *